US006265956B1

(12) United States Patent
Cascolan et al.

(10) Patent No.: US 6,265,956 B1
(45) Date of Patent: Jul. 24, 2001

(54) PERMANENT MAGNET LATCHING SOLENOID

(75) Inventors: Anthony J. Cascolan, Lombard; Ralph E. Mishler, Willowbrook, both of IL (US)

(73) Assignee: Magnet-Schultz of America, Inc., Westmont, IL (US)

( * ) Notice: Subject to any disclaimer, the term of this patent is extended or adjusted under 35 U.S.C. 154(b) by 0 days.

(21) Appl. No.: 09/470,390

(22) Filed: Dec. 22, 1999

(51) Int. Cl.[7] ..... H01F 7/00; H01F 7/08

(52) U.S. Cl. ..... 335/234; 335/278; 335/281

(58) Field of Search ..... 335/229–234, 335/236, 278, 281; 29/602.1, 607

(56) References Cited

U.S. PATENT DOCUMENTS

| | | | |
|---|---|---|---|
| 3,022,450 | 2/1962 | Chase, Jr. | 317/123 |
| 3,070,730 | 12/1962 | Gray et al. | 317/190 |
| 3,178,151 | 4/1965 | Caldwell | 251/137 |
| 3,202,886 | 8/1965 | Kramer | 317/171 |
| 3,248,499 | 4/1966 | Young | 200/93 |
| 3,305,209 | 2/1967 | Bender et al. | 251/137 |
| 3,460,081 | 8/1969 | Tillman | 335/234 |
| 3,503,022 | 3/1970 | Burdett | 335/256 |
| 3,504,315 | 3/1970 | Stanwell | 335/234 |
| 3,514,674 | 5/1970 | Ito et al. | 317/155.5 |
| 3,576,473 | 4/1971 | Genbauffe et al. | 317/155.5 |
| 3,634,735 | 1/1972 | Komatsu | 317/154 |
| 3,728,654 | 4/1973 | Tada | 335/234 |
| 3,743,898 | 7/1973 | Sturman | 317/154 |
| 3,814,376 | 6/1974 | Reinicke | 251/65 |
| 3,859,547 | 1/1975 | Massie | 310/14 |
| 3,870,931 | 3/1975 | Myers | 317/146 |
| 4,253,493 | 3/1981 | English | 137/625.18 |
| 4,422,060 | 12/1983 | Matsumoto et al. | 335/256 |
| 4,479,162 | 10/1984 | Offutt et al. | 361/210 |
| 4,486,728 | 12/1984 | Hastings et al. | 335/256 |
| 4,494,098 | 1/1985 | Haneda et al. | 335/230 |
| 4,514,710 | 4/1985 | Conrad | 335/230 |
| 4,682,135 | 7/1987 | Yamakawa | 335/256 |
| 4,751,487 | 6/1988 | Green, Jr. | 335/234 |
| 5,016,681 | 5/1991 | Ghiardo | 139/452 |
| 5,166,652 | 11/1992 | Koyama et al. | 335/234 |
| 5,300,908 | 4/1994 | Stone et al. | 335/256 |
| 5,365,210 | 11/1994 | Hines | 335/238 |
| 5,757,259 * | 5/1998 | Fulford et al. | 336/92 |
| 5,808,534 * | 9/1998 | Laffey | 335/250 |
| 5,821,840 * | 10/1998 | Ricker | 335/128 |

OTHER PUBLICATIONS

Drawings of Magnet–Schultz, Memmingen/Algäu (Germany) prior "DC Magnet—Reverse Stroke" (Nine sheets, with titles translated into English and proprietary information deleted), No Date.

Drawings of Magnet–Schultz BCI DC Solenoid (Pull Type), Part/Drawing Nos. S–08600, 018–0214–000, 099–0241–XXX, 183–0882–000, 247–0015–000, 231–0361–001, and 253–0348–000 (7 Sheets; Undated).

Drawings of Magnet–Schultz BCI DC Solenoid (Push Type), Part/Drawing Nos. S–08192, 025–0381–000, 075–0192–00, 075–0192–001, 099–0241–XXX, 099–0241–041, 231–0355–000, 231–0355–001, 246–0172–010, 182–0939–000, and 182–0939–001 (11 Sheets; Undated).

* cited by examiner

*Primary Examiner*—Ramon M. Barrera
(74) *Attorney, Agent, or Firm*—Leydig, Voit & Mayer, Ltd.

(57) ABSTRACT

A permanent magnet latching solenoid with a central passage carrying a reciprocative armature has a magnetically permeable bushing press-fit in each end of the bobbin. The outer ends of the bushings define the outer ends of the bore. A separate preformed magnetically permeable frame surrounds the bobbin and includes end wall portions that abut the outer ends of the bushings. The bobbin assembly is inserted laterally into the frame, with the ends of the bushings against the ends of the frame. Openings in the end walls of the frame accommodate free passage of an operator rod element which is affixed to the armature.

32 Claims, 6 Drawing Sheets

65
30a
24
30b
36b
36a 26
24
36b
36a 65
82b
22
92b 38
65
82b
24
82b
82a
46b
22
95
92b
95
46a
48a 82b
94b
22
34

92b
94b
82b
38

PERMANENT MAGNET LATCHING SOLENOID

FIELD OF THE INVENTION

This invention relates to solenoids, especially to permanent magnet latching-type solenoids.

BACKGROUND OF THE INVENTION

There are numerous uses for solenoids that have a plunger which may be held in either of two end positions while being selectively movable between those positions by pulsed energization of an electromagnetic coil. Uses of such devices include holding, locking, or latching another device in a predetermined position, subject to release upon appropriate energization of a coil in the solenoid. All such uses are sometimes referred to hereinafter as "latching." One particular example is the use of a latching solenoid to lock the cover of a computer device in a closed position.

A typical magnetic latching solenoid basically comprises a conventional electrical coil operated solenoid with a permanent magnet in the structure. The permanent magnet provides a permanent magnetic attraction force for retaining a solenoid armature, sometimes referred to as a "plunger," in either of two end positions. The electric coil is used to generate a momentary pulse of a magnetic field to momentarily overcome the magnetic attraction field of the permanent magnet and to drive the plunger to change its position. The resulting movement of the plunger will drive a push rod that may be used to perform a locking operation. The same coil or another coil then may be energized momentarily in an opposite sense to release and move the plunger in the opposite direction for unlocking purposes, such as by using an electrical pulse generating device that is activated only upon entry of an appropriate code on a related keyboard. Latching solenoids are used in great numbers for such operations. It is desirable to provide solenoids which will operate reliably for such uses and which can be produced in a facile manner at low costs.

OBJECTS AND SUMMARY OF THE INVENTION

The general aim of the present invention is to provide improved latching solenoids, and, particularly, improved double acting permanent magnet latching solenoids.

It is another object of this invention to provide solenoids of designs which can be manufactured and assembled in a facile, economic manner.

A further object of this invention is to provide an improved method to facilitate economic assembly of such solenoids.

These and other objects and advantages of the invention will become more apparent from the following description and the accompanying drawings.

A permanent magnet latching solenoid is provided which comprises a bobbin of non-magnetic material that carries the actuating electrical winding. The bobbin has a central passage for receiving a reciprocative plunger, often referred to herein as the armature. A hollow cylindrical magnetically permeable bushing is mounted in each end of the bobbin, with the internal opening of each of those bushings providing an extension of the central bobbin passage, to define a bore in which the armature has free sliding reciprocative movement. The outer ends of the bushings, sometimes referred to herein as the "distal" ends, define the ends of that bore. A separate magnetically permeable frame surrounds the bobbin and includes end wall portions that extend close to and preferably abut the distal ends of the bushings. Each bushing thus is closely coupled magnetically with a respective end wall of the frame. At least one permanent magnet is mounted between the bobbin and the frame. In the preferred embodiment two permanent magnets of equal magnetic power are disposed on opposite sides of the bore in which the armature moves. Openings in the end wall portions of the frame accommodate free passage of an operator rod element which is affixed to the armature. This rod element serves as the operator element for carrying out one or more desired functions, such as locking another component in a predetermined position. One example of such use is in locking a computer cover, as noted above.

The armature is of an axial length that is substantially less than the length of the bore and is freely movable there along between two end positions by the permanent magnets and the electric coil. More specifically, the armature is of a length such that when one end portion of the armature is within the bushing at one end of the bore, with the respective end of the armature abutting or in close-coupled magnetic relation to the respective end wall of the frame, the opposite end of the armature is near the inward end of the bushing at the opposite end of the bore. With the armature in such a first end position, the magnetic field of the permanent magnets is concentrated through the respective mutually adjacent end portions of the frame, the respective bushing and the armature, for example the right end portions in FIG. 1, to hold the armature in that first end position. However, an appropriate brief pulsing of the coil, such as for about 50 milliseconds, temporarily will create an opposing magnetic field, i.e., opposing the field of the permanent magnet, to release the armature from that first end position and create an attractive field therefor through the bushing and end wall at the opposite end and thereby impel the armature from the first end position toward the opposite end position.

The bushing around the seated end of the armature shunts a portion of the magnetic field of the permanent magnets radially from the armature to the respective bushing and thence to the adjacent end wall of the frame. This reduces the axial magnetic seating force on the armature and accordingly facilitates release of the armature upon pulsing of the respective coil for movement of the armature toward the opposite end of the frame. Further, the axial adjacency of the other bushing to the opposite end of the armature enhances the axial magnetic attraction force that is briefly applied to the armature by the respective coil for impelling the armature toward that opposite end.

The electrical pulse through the coil should impel the armature significantly past a longitudinally centered position in the bore, whereafter the attractive force of the permanent magnet circuit through the opposite end of the frame and the related adjacent bushing will predominate and complete the movement of the armature to the opposite end position in abutment or close coupled relationship with that opposite end of the frame. The magnetic field generated by the permanent magnet will thereafter retain the armature in that opposite end position until such time as an opposite electrical pulsing of the coil will similarly impel the armature back toward the first end position.

The permanent magnet(s) provides holding force in each end position, without any continuing current being necessary through the coil. Dual coil windings may be provided for converting electrical pulses to the appropriate magnetic flux patterns, or a single coil may be used with appropriate power pulsing techniques, as is known in this art.

Several features relate to the numerous benefits available with this invention. For example, the magnetic frame preferably is preformed of a single piece of conductive material, i.e., magnetically permeable metal, with opposite ends joined to form a unitary hollow box-like structure which is open on at least one side to allow lateral sliding insertion of the bobbin assembly. The magnetically permeable end bushings are press-fit into appropriate end portions of the bobbin, with their opposite end surfaces being spaced a distance which is essentially equal to the internal length dimension of the magnetic frame. The armature is inserted in the bore of the bobbin. This forms an assembly of the wound bobbin, bushings and armature which may be slid laterally into the described frame. A non-magnetic operating rod is then inserted through at least one opening in an end wall of the frame and secured to the armature. This rod provides an external operating element to make appropriate use of the movement and positioning of the armature, as well as to hold the described bobbin assembly within the frame. In one alternative construction, one or both end walls may be notched inward from an open side of the frame to the solenoid axis to accommodate the operating rod. Thereby the operating rod may be affixed to the armature prior to insertion of the bobbin assembly into the uni-frame. However, this alternative will reduce the area of the frame available for magnetic coupling with the respective end bushing.

In the preferred embodiment, the armature is hollow and the non-magnetic operating rod is extended through an opening in one end wall, through the armature, and through an opening in the opposite end wall of the frame. The rod is affixed to the armature by an appropriate attachment arrangement, such as having it forced-fit in the armature opening or by threaded engagement, such that the operating rod reciprocates as the armature reciprocates in response to the respective magnetic forces.

The permanent magnet, or preferably two permanent magnets, are added to the assembly, preferably by being inserted in a force-fit between the outer surface of the bobbin and the inner surface of the longitudinal surfaces of the side walls. Placing of magnets on opposite sides of the bobbin avoids mechanical impact of the movable armature against the magnets and also avoids a net lateral biasing force on the armature by the respective permanent magnet fields. The latter avoids having the armature pressed laterally against one side or the other of the bore by the permanent magnet field and thereby minimizes sliding friction as the armature moves back and forth along the bore. The passage through the bobbin also may be formed with axially extending radial ribs to assist in centering the armature, reduce sliding friction, and permit ready air flow between the armature and the wall of the passage to minimize or avoid the formation of an effective air seal and any attendant-airlock impediment to free reciprocative movement of the armature.

The end bushings may be formed in any configuration for mating with the bobbin and with the end portions of the armature, but preferably are simple right circular cylindrical sleeves. Further, the bushings may be formed in any manner, including stamping and rolling techniques, but preferably are screw machine-type parts for greater accuracy of configuration and tolerance control. Accuracy of seating and alignment of the subassembly within the frame is enhanced by providing detent-type interlocking relationships between appropriate protuberances and recesses of the bobbin and the frame, preferably with a final staking of the frame to enhance the positional accuracy obtained by that detent engagement.

Figure 1:
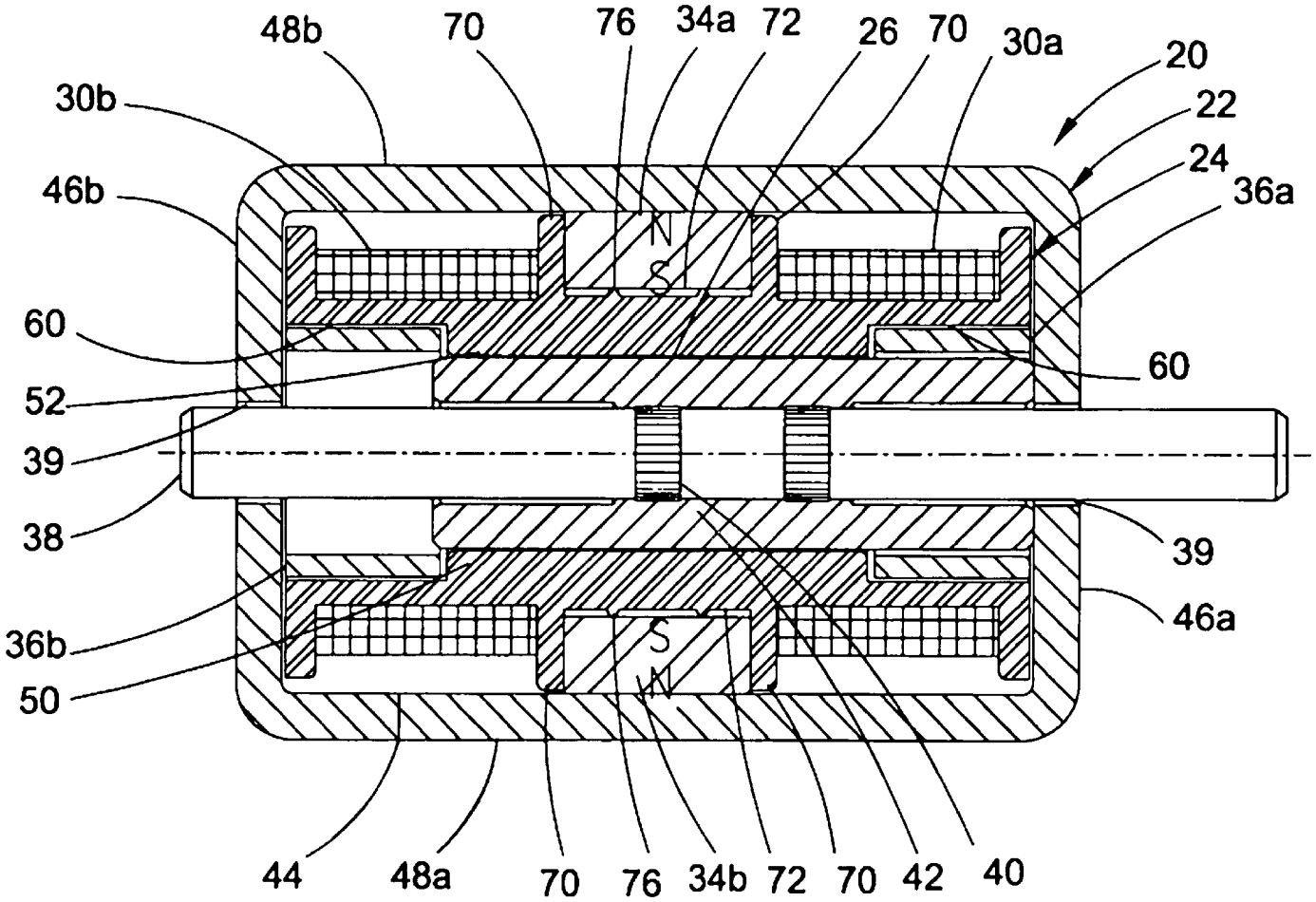
FIG. 1 is an illustrative center section view of a permanent magnet latching solenoid employing teachings of this invention, taken generally along line 1—1 of FIG. 3.
Figure 2:
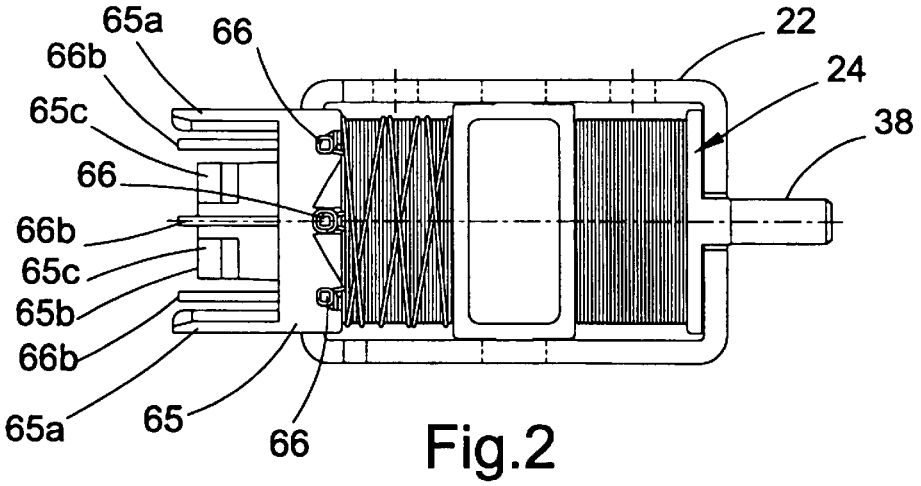
FIG. 2 is a top view of a permanent magnet latching solenoid employing teachings of this invention.

While the invention is susceptible to various modifications and alternative constructions, a preferred embodiment has been shown in the drawings and will be described in detail. It will be understood, however, that there is no intention to limit the invention to the specific embodiment illustrated or to other embodiments that are described or specifically suggested herein, but on the contrary, the intention is to cover all modifications, alternative constructions and methods and equivalents falling within the spirit and scope of the invention.

DETAILED DESCRIPTION OF THE PREFERRED EMBODIMENT

For purposes of illustration, one presently preferred embodiment of the invention is shown in the drawings and described in detail below. In that embodiment, a dual latching permanent magnet solenoid 20 comprises a rectangular metal frame 22 in which is disposed a bobbin assembly 24 that carries a reciprocally movable armature 26. The bobbin assembly includes a bobbin 28 which carries a pair of electrical coil windings 30 (designated herein as 30*a* and 30*b*). A pair of permanent magnets 34 (designated herein as 34*a* and 34*b*) are disposed between the frame 22 and center portions of the bobbin 28, between the coils 30*a* and 30*b*. A pair of short magnetically permeable metal bushings 36 (designated herein as 36*a* and 36*b*) are engaged within the respective ends of the bobbin 28. An operating element in the form of a non-magnetic operating rod 38 extends through the frame 22 and the bobbin assembly 24, being engaged with the armature 26 for reciprocating movement by the armature as the armature is moved back and forth in the assembly. Openings 39 are provided in the end walls of the frame for such passage of the rod 38. It will be apparent that movement of the outwardly extending end portion of the rod 38 can be utilized to perform a desired function in accordance with the actuation of the solenoid. A specific purpose of the illustrated embodiment is to serve as a latch or lock for holding closed the cover of a computer housing. In the illustrated embodiment, axial force-transfer engagement between the rod 38 and the armature 26 is obtained by force-fit engagement of the rod within the armature 26, as by knurled rod portions 40 having force-fit engagement with a reduced diameter center section 42 of the armature. It will be appreciated that other engagement arrangements may be utilized, such as, for example, threadable engagement of either one unitary rod or two separate rod sections with the armature.

Figure 3:
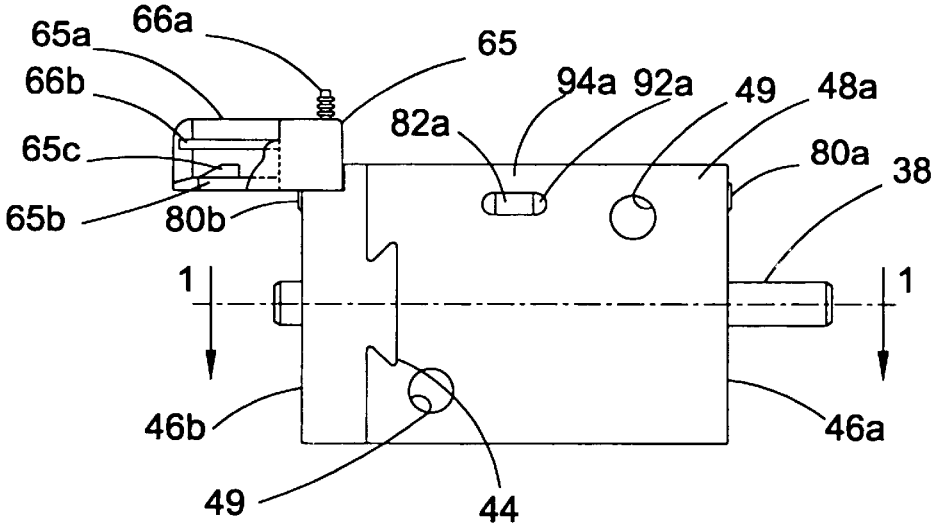
FIGS. 3, 4, and 5 are, generally, front, back and bottom views, respectively, of the solenoid of FIG. 2.
Figure 4:
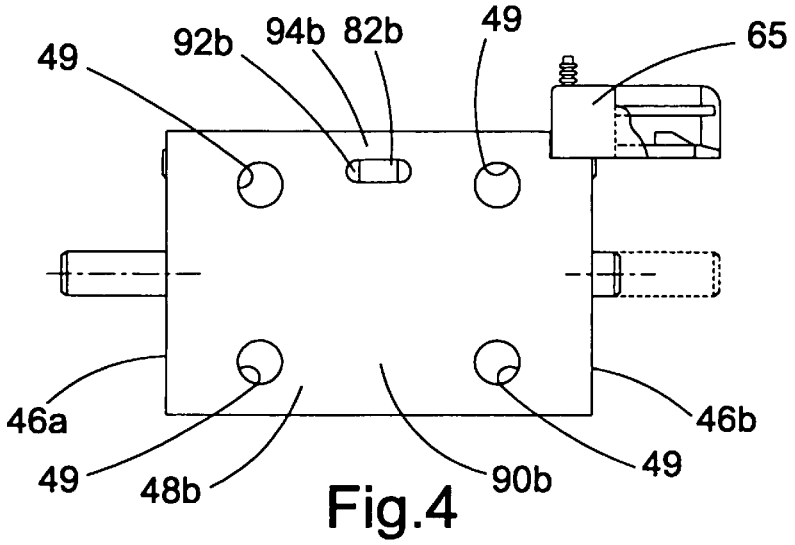
Figure 5:
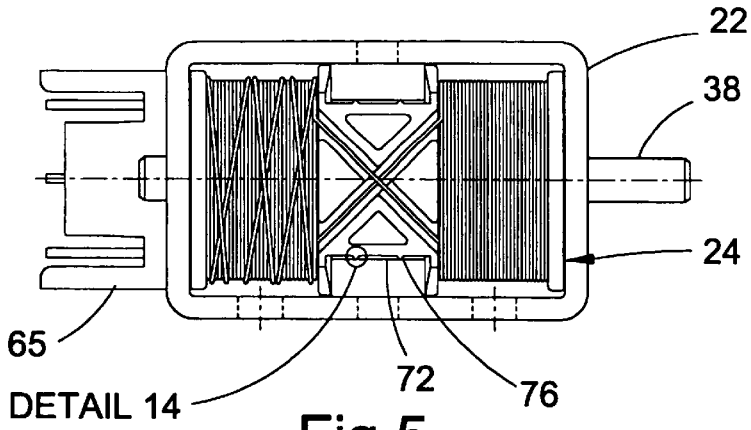

Referring also to FIGS. 2–7, the frame 22 is of a unitary rectangular box construction, such as by being formed of a single strip of metal with its opposite ends joined at a dovetail joint as illustrated at 44 in FIG.3. Such a one-piece frame also is referred to herein as a "uni-body" frame. The frame 22, which includes opposed end walls 46*a* and 46*b* and opposed side walls 48*a* and 48*b* that join the end walls, is open at two opposed sides which also may be referred to from time to time as the "top" or "bottom" sides. Openings 49 are provided in the frame, as desired, for mounting of the solenoid to other structures. As will be noted further below, the solenoid bobbin assembly is assembled with the frame by insertion through one of the open sides. It will be appreciated that only one open side is necessary to obtain the benefits of this mode of assembly.

Figure 10:
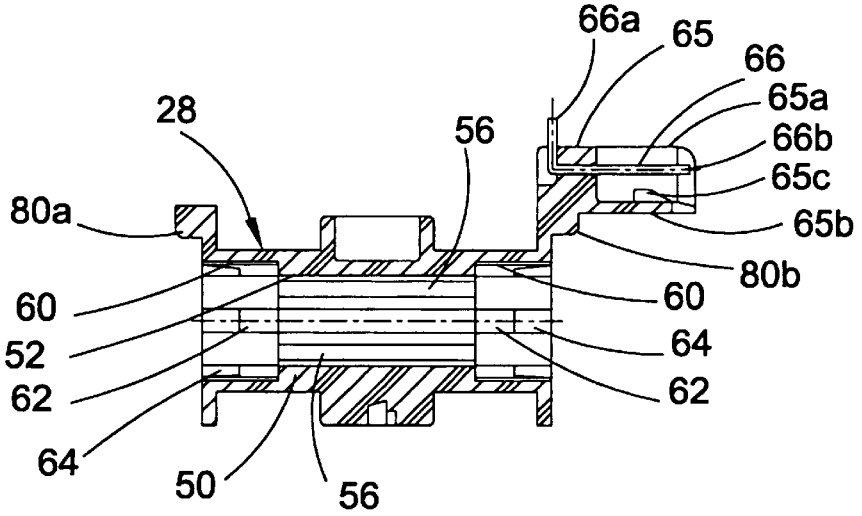
FIG. 10 is a sectional view taken generally along the line 10—10 of FIG. 12 and showing one of the connection posts mounted in the connector tower of the bobbin.
Figure 11:
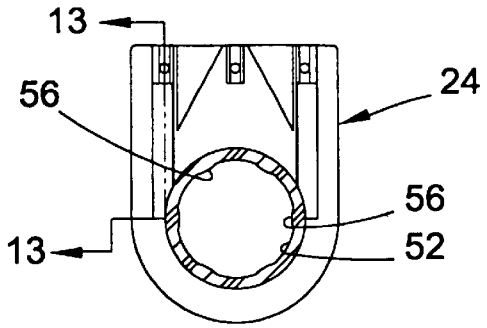
FIG. 11 is a sectional view taken generally along the line 11—11 of FIG. 8.
Figure 15:
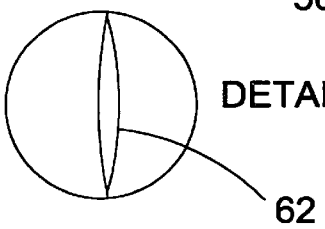
FIG. 15 is an enlarged end view detail of one of the friction ribs for engaging a bushing in an end section of the bobbin, as noted in FIG. 12.
Figure 12:
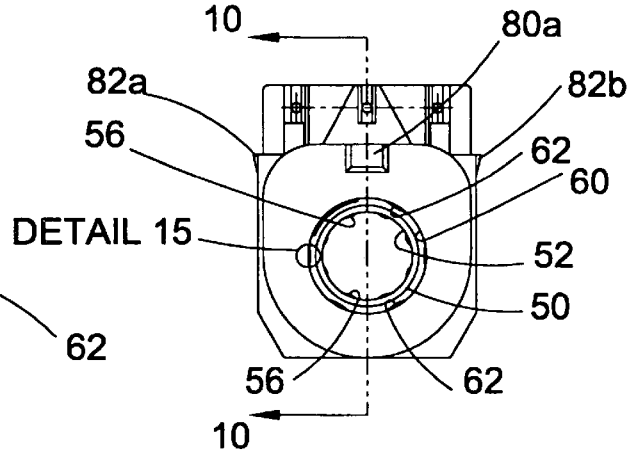
FIG. 12 is a left end view of the bobbin of FIG. 8.
Figure 13:
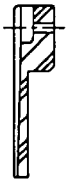
FIG. 13 is a partial section view taken generally along the line 13—13 of FIG. 11.
Figure 14:
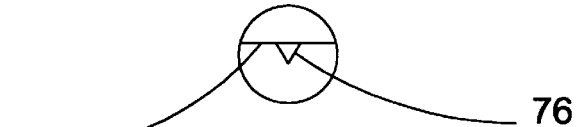
FIG. 14 is an enlarged top view detail of the crush rib on the bobbin, as noted on FIG. 5.

Referring to FIGS. 1 and 10, the bobbin 28 has an opening therethrough and includes a center section 50 that defines an axial passage 52 in which the armature reciprocates, that is, moves back and forth axially of the assembly between its right end position as shown in FIG. 1, where the right end of the armature abuts the right end wall 46*a* of the frame, and a left end position in which the left end of the armature will abut the left end wall 46*b* of the frame. To minimize the frictional resistance to such movement of the armature while maintaining accurate radial positioning and to permit air movement to avoid an air lock effect against the free movement of the armature, the center section 50 preferably is formed with a plurality of slightly raised ribs 56; see FIG. 11. Each of the ribs 56 is concave in cross-section. These ribs extend from end-to-end of the passage 52, parallel to one another and to the axis of the passage 52. It will be appreciated that at least three such ribs should be provided for beneficial positioning and movement of the armature. As seen in FIG. 11, six such ribs are included in the illustrated embodiment. Each end of each rib 56 is tapered radially outwardly, to the full inner diameter of the passage 52, at each end of the passage for ease of insertion of the armature.

Each of the bushings 36*a*, 36*b* has an internal diameter corresponding to or slightly larger than the inner diameter defined by the ribs in the passage 52. The bushings 36 extend axially from the respective ends of the passage 52 to or slightly beyond the end of the bobbin 28. Thus, the bushings 36 together with the passage 52 define a bore within which the armature 26 moves between its respective end positions. In the preferred embodiment, each of the bushings 36 engages the bobbin 28 in a manner to assure retention therein when these components are joined with one another in a subassembly prior to insertion of the bobbin assembly into the frame 22. As noted above, the bushings 36 are magnetically permeable. In this preferred embodiment, each of those bushings is a simple hollow right circular cylinder of metal. They may be formed very inexpensively by a stamping and rolling technique. However, in the preferred embodiment, they are of a continuous cylindrical configuration, as by being formed on a screw machine, for obtaining accuracy and consistency of the cylindrical curvature and improved dimensional tolerances.

Referring to FIGS. 1, 10, 12, and 15, the ends of the bobbin 28 are formed with enlarged recesses 60 for receiving and engaging the bushings 36. The bobbin 28 is formed with a plurality of axially extending friction or crush ribs 62, and each of those ribs is provided with a radially outwardly tapered distal end 64 for ease of insertion and press-fit retention of the bushings 36.

The bobbin 28 also includes a connection pedestal 65 at one end. Electrical connector pins 66 are mounted in the pedestal 65 for appropriate engagement and latching with the mating connector. Each of those contacts 66 includes a connecting post 66*a* for attachment of the wires of the windings 30*a*, 30*b*. In the illustrated embodiment, three pins 66 are provided for the separate coil circuits, with one of the pins serving as a common ground. The pins 66 and the unique configuration of the pedestal 65 provide for convenient electrical connection of the solenoid 20 to an appropriate external power circuit. Referring particularly to FIGS. 2, 3, 6 and 10, the pin legs 66*b* serve as male contacts for mating with an appropriate female electrical connector of a power supply. The molded connection pedestal 65 includes opposed spaced side walls 65*a* and a bottom wall 65*b* which protect the pin legs 66*b* during handling of the solenoid as well as receiving such a mating connector therebetween. Appropriate latching elements, such as the protrusions 65*c*, are provided for retentive engagement with such a mating connector.

Referring particularly to FIGS. 1, 5, 8, 9, and 14, the bobbin 28 also defines two pockets 68 (68*a* and 68*b*) in diametrically opposed relationship to one another between the coils 30*a* and 30*b*, for accommodating the permanent magnets 34. Each of those magnets is of simple cylindrical configuration, being seen in a diametrical cross-section in FIG. 1. Each of the pockets 68 is formed by a pair of parallel side walls 70, a back wall portion 72 and an end wall 74, and has an open "downward" end. As perhaps best seen in FIGS. 8 and 9, the side walls 70 include upper inner surface portions 70*a* that are parallel to one another and spaced apart a distance for a close fit of a magnet 34 therebetween. The lower inner wall surfaces 70*b* taper outward in diverging relationship to one another to facilitate insertion of the magnets through the open ends of the pockets, as noted further below. The bobbin 28 also includes a pair of narrow retention ribs 76 which protrude slightly from the respective back wall 72 and extend longitudinally of the respective pocket 68, parallel to the side walls 70. Each of the ribs 76 includes a tapered ramp-shaped outer end surface 78 to further facilitate insertion of the magnets.

In the preferred embodiment 20, the frame 22 and bobbin 24 include gauge elements which cooperate with one another to facilitate accurate positioning of the bobbin assembly in the frame. As seen, for example, in FIGS. 6–10 and 12, the bobbin 24 includes narrow positioning tabs 80*a* and 80*b* that extend axially outward from the upper portions of the respective end walls of the bobbin, as well as latch tabs 82*a* and 82*b* that extend laterally outward from the upper portions of the vertical side walls of the center section of the bobbin.

Figure 6:
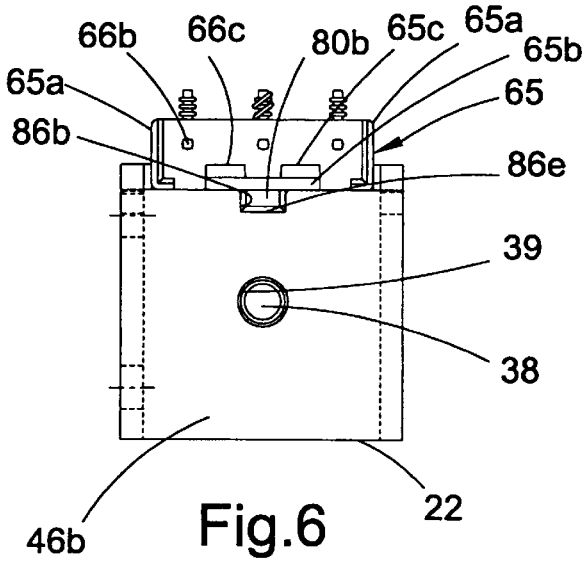
FIGS. 6 and 7 are right- and left-end views of the solenoid of FIG. 2, with FIG. 7 being partially in section.
Figure 7:
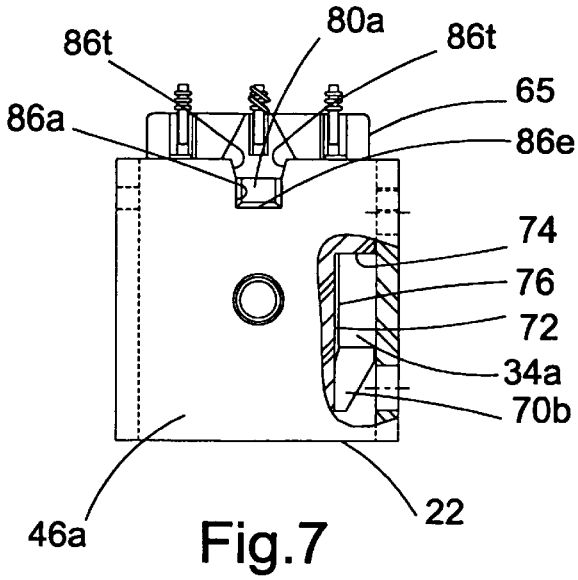
Figure 8:
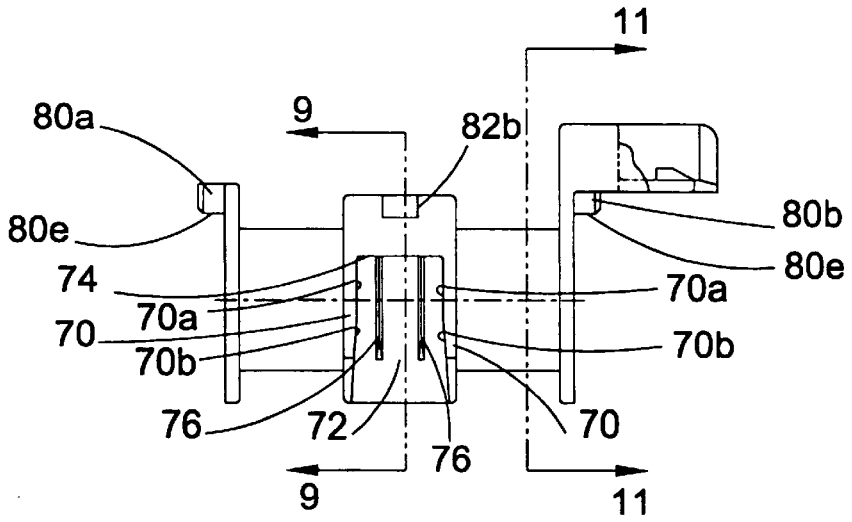
FIG. 8 is a side view of the bobbin of the solenoid of FIG. 2.
Figure 9:
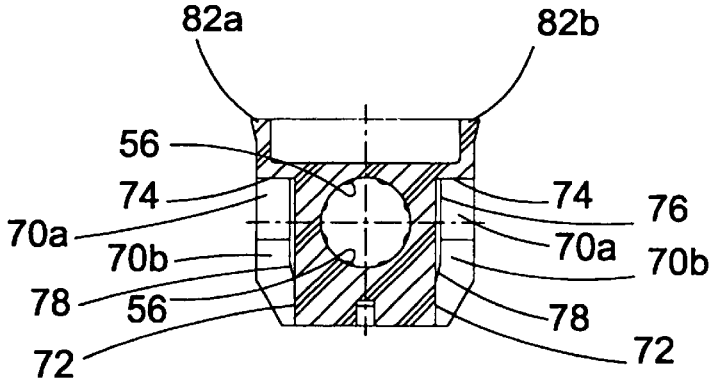
FIG. 9 is a sectional view taken generally along the line 9—9 of FIG. 8.

Referring also to FIGS. 6 and 7, each end wall 46*a*, 46*b* of the frame 22 is formed with an open ended notch 86*a*, 86*b*, respectively, for snugly receiving the respective tab 80*a*, 80*b* in firm seating relation on the inner end surface 86*e* of the respective notch. The end wall 46*b* is of reduced height relative to the other portions of the frame, including the opposite end wall 46*a*. That reduced height accommodates the connector pedestal 65 of the bobbin 24. Because the lower surfaces 80*e* of the tabs 80*a* and 80*b* are essentially coplanar, the difference in the height of the end walls means that the notch 86*a* is of greater depth than the notch 86*b* to provide correspondingly coplanar inner end surfaces 86*e* for seating of the tabs 80*a*, 80*b* thereon. The outer portion of the side walls of the respective notches 86*a*, 86*b* may be tapered outwardly to facilitate entry and seating of the respective tabs; see the tapered surfaces 86*t* in FIG. 7.

Each of the side walls 48*a*, 48*b* of the frame 22 is formed with a small aperture 92*a*, 92*b* to receive the respective latch tab 82*a*, 82*b* in a snap engagement relationship when the bobbin assembly is inserted into the frame. In the preferred embodiment, the apertures 92 are sufficiently close to the side of the frame 22 through which the bobbin assembly is inserted (sometimes referred to herein as the "top" edge) that the intervening side wall portions 94*a* and 94*b* may be staked inward as illustrated in FIG. 16F to press inward on the tabs 82*a*, 82*b* and assure seating of tabs 80*a* and 80*b* on the inward surfaces 86*e* of the notches 86*a*, 86*b* for accurate positioning of the bobbin assembly in the frame.

By way of one specific example, a solenoid as described in respect to the drawings herein had a plain rectangular magnetically permeable steel frame of about 0.060" thickness that defined an open-sided cavity about 1" long and ⅝" wide. The bobbin was about 1" long with a bore inner diameter slightly larger than ¼" and a center passage about 0.60" long, and carried dual coils. Each steel end bushing was about 0.20" long with an inner diameter slightly greater than ¼" and a wall about 0.050" thick. The armature was about 0.80" long with a 0.250" outer diameter. Providing the bushings with a nominal inside diameter about 0.028" greater than the nominal outside diameter of the armature provided ease of assembly, freedom of movement and apparently optimum magnetic efficiencies for holding (latching) and for driving the armature. The operating rod was formed of 305 stainless steel and was about 1.5" long and about 0.12" outer diameter, and was force fit in the armature. By way of example, a press-fit that will transfer 100 pounds or more of axial force between the rod and the armature without slippage was provided in that embodiment. Two nickel over copper plated neodymium-iron boron permanent magnets were used, each 0.250" in diameter and 0.100" thick.

The design of the preferred embodiment 20 permits a method of fabrication and assembly which is another feature of this invention. In that method, the frame is prefabricated as a uni-body construction, including the end walls as well as the side walls. This preferably is accomplished by forming the frame of a single piece of metal to avoid the cost and expense of fitting and separately securing the various walls to one another, but could be accomplished by other pre-assembly techniques. The bobbin 24 is wound to provide the desired coil or coils 30, as preferred for the intended manner of operation. Referring particularly to FIG. 16A, the bushings 36*a* and 36*b* are inserted into the respective end recesses 60 of the bobbin 24. The press-fit engagement of these bushings with the bobbin 24 serves two functions. It retains the bushings in the assembly during subsequent handling and also permits leaving each bushing extending slightly beyond the respective end wall of the bobbin 24, as illustrated in FIG. 16B, until final seating of the subassembly in the frame. The armature 26 then is inserted into the central axial bore defined by the bushings 36 and the passage 52 in the center of the bobbin 24, see FIG. 16B. The resulting bobbin assembly then is moved laterally through the "top" open side of the frame 22, as illustrated generally in FIG. 16C. The upper inner edges of the respective end walls 46*a* and 46*b* preferably are beveled at their inner edges (as illustrated at 95 in FIG. 16C) to serve as cam surfaces to push the respective bushings 36*a* and 36*b* further into the bobbin 24. This cam action results in custom seating of each bushing to assure abutment or at least very close proximity of each bushing to the respective end wall to enhance the magnetic flux coupling therebetween during operation of the solenoid. The lateral insertion step illustrated in FIG. 16C culminates in the seating of the tabs 80*a* and 80*b* on the inner end surfaces 86*e* in the respective notches 86*a* and 86*b* of the frame and snapping the cam-latch protuberances 80*a* and 80*b* into the respective apertures 92*a* and 92*b*. In this mated or seated relationship of the frame 22 and the bobbin assembly 24, the bore through the bobbin is in co-axial alignment with small openings 39 through the end walls 46*a* and 46*b*.

Figures 16A, 16B, 16C, 16D, 16E, 16F:
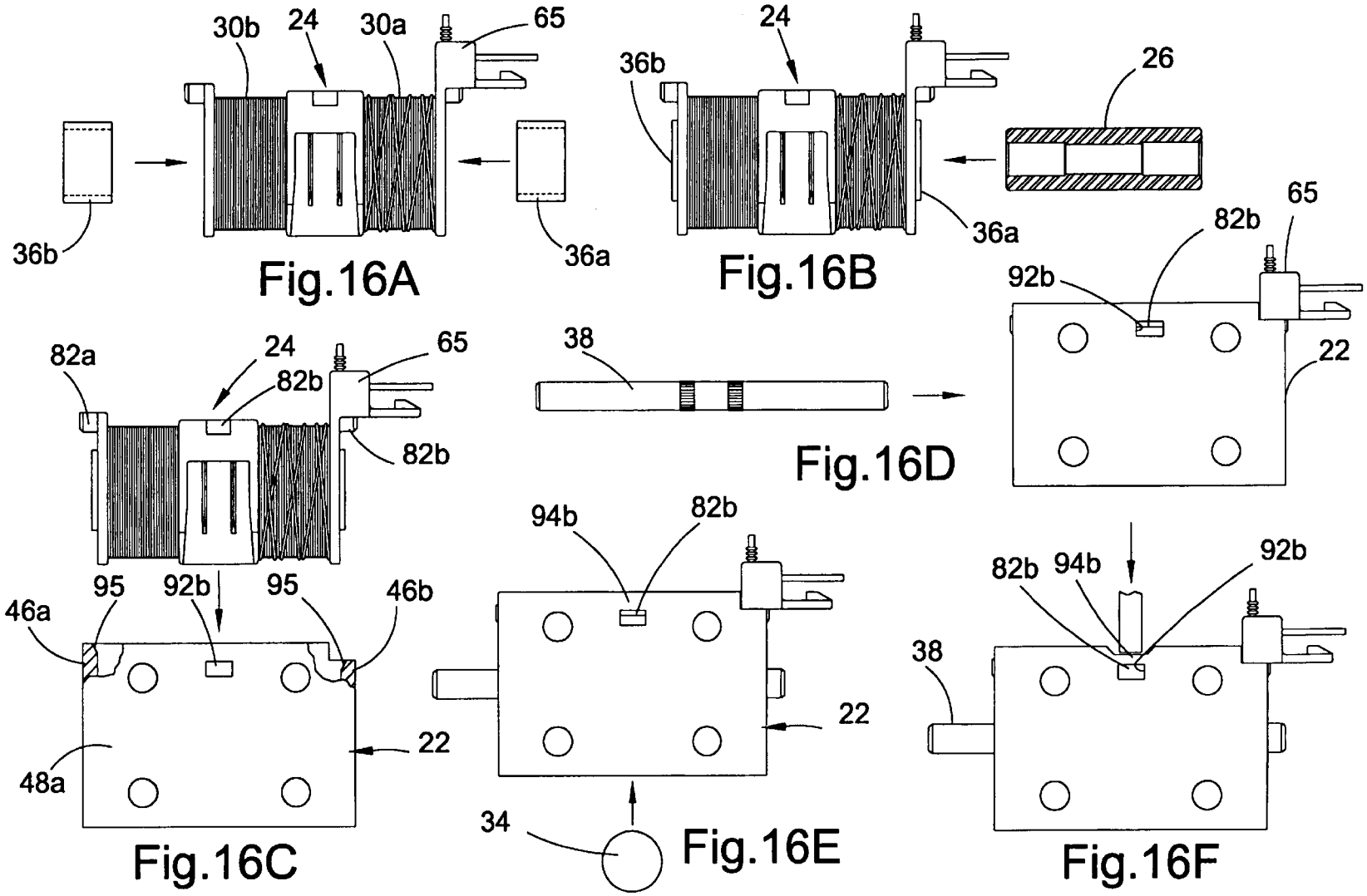
FIGS. 16A through 16F are schematic illustrations of steps in a method of assembling a permanent magnet latching solenoid employing teachings of this invention.

After the seating step of FIG. 16C, the non-magnetic operating rod element 38 is inserted through the opening 39 in the respective end wall, as illustrated in FIG. 16D. The rod 38 is affixed to the movable armature 26 by press-fit engagement therein and thereafter is moved with the armature. The illustrated rod 38 is of sufficient length that it protrudes through the armature and through the opening 39 in the opposite end wall, and protrudes outward of both end walls in both end positions of the armature in the preferred embodiment; see FIGS. 16E and 16F and the two end positions illustrated in FIG. 4. The openings 39 are only slightly larger than the cross-section of the operating rod 38, for example by providing 0.134" diameter openings 39 for a 0.120" operating rod. Such a close-fitting relationship assures lateral support for the rod 38 by the frame 22 when the rod serves as a locking device, as well as in other circumstances where the rod 38 is subjected to lateral forces. The openings are of substantially lesser size than the bushings 36 and the cross-section of the bore.

Referring to FIG. 16E, the magnets 34 then are inserted between the frame and the bobbin by being pushed into the center pockets 68*a*, 68*b*, through the open lower ends of those pockets, and against the end stop walls 74. This achieves accurate centering of the magnets relative to the bore through the bobbin. The narrow crushable ribs 76 permit dimensioning the respective components such that the ribs 76 assure seating of the magnets against the respective adjacent side walls of the frame 22. The press-fit of the ribs 76 as well as the frictional or press-fit engagement of the magnets with the sides 70 of the pockets 68*a*, 68*b* assist in retaining the magnets in position in the assembly. It will be appreciated that the magnetic field attraction of the magnets to the walls of the frame and to the armature also assist in retaining the magnets in position. The magnets are inserted with like poles disposed inward, toward the armature, as illustrated in FIG. 1 and with the opposite poles disposed outward toward the frame 22.

Referring to FIG. 16F, the narrow portions 94*a* and 94*b* of the side walls then may be staked downward against the upper surfaces of the latch elements 82*a* and 82*b* to press the bobbin assembly downward and thereby assure accurate firm seating of the gauging protuberances 80*a* and 80*b* of the bobbin against the bottom surfaces 86*e* of the notches 86*a* and 86*b* in the frame. Thus, the abutting surfaces of the protuberances 80*a* and 80*b* and the inward surfaces of the apertures 86*a* and 86*b* serve as references for accurate positioning of the internal components with the surrounding frame.

From the foregoing, it can be seen that permanent magnet latching solenoids, and methods of assembly of those solenoids, have been provided which accomplished the aforenoted objects of this invention.

It will be understood that other variations, modifications and substitutions of equivalent configurations can be effected within the spirit and scope of this invention, particularly in light of the foregoing teachings. It is contemplated by the following claims to cover any such modifications and other embodiments that incorporate those features which constitute the essential features of the invention within the true spirit and scope of the following claims.

We claim:

1. A permanent magnet latching solenoid which comprises a bobbin that defines an axial passage, an electrical winding on said bobbin, magnetically permeable bushings engaged with said bobbin at each end of said passage, said bushings defining with said passage a bore which extends axially of said bobbin from the distal end of one of said bushings to the distal end of the other of said bushings, an armature within said bore, said armature being of an axial length substantially less than the axial length of said bore and being freely reciprocable axially of said bore between two end positions in each of which one end portion of said armature is within the bushing at the respective end of said bore and an opposite end portion of said armature is at least near the bushing at the opposite end of said bore, an operator element attached to said armature, a separate magnetically permeable frame around said bobbin and including opposed end walls extending over said distal ends of said bushings, whereby each of said end walls overlies said distal end of the respective bushing and an assembly comprising said bobbin, said bushings and said armature fits within said frame between said end walls, said distal ends of said bushings being disposed adjacent to and in magnetically permeable coupling relationship with the respective end walls, at least one permanent magnet disposed within said frame between said bushings and located between said frame and said bore, said permanent magnet magnetically coupling with said armature and said frame to magnetically latch said armature in each of said end positions, and said coil, when activated by an appropriate electrical pulse, creating a magnetic field coupling through said frame, armature and bushings to drive said armature from either of said end positions toward the other of said end positions.

2. A permanent magnet latching solenoid as in claim 1 wherein said bushings abut the inner surfaces of the respective end walls of said frame.

3. A permanent magnet latching solenoid as in claim 1 wherein said frame is of unitary construction having at least one open side through which an assembly comprising said bobbin, said bushings and said armature is receivable into said frame.

4. A permanent magnetic latching solenoid as in claim 3 wherein said bushings are of axial lengths substantially equal to one another and abut the respective end walls of said frame.

5. A permanent magnetic latching solenoid as in claim 3 wherein said frame is of one-piece construction.

6. A permanent magnetic latching solenoid as in claim 3 wherein at least one of said end walls has an opening therethrough aligned with said bore and which is of lesser size than said bore and the respective end portion of the armature, and said operator element includes at least one portion extending through said opening and engaging said armature for movement therewith.

7. A permanent magnet latching solenoid as in claim 6 wherein said end walls have aligned openings therethrough, each of said openings being of lesser size than said bore and the respective end portion of the armature, and said operating element includes portions extending through each of said openings and engaging said armature for movement therewith.

8. A permanent magnet latching solenoid as in claim 1 wherein said armature defines an opening therethrough, said end walls of said frame have openings therethrough of lesser size than the cross-section of the respective end portion of said armature, and said operator element is an elongate member which extends through and engages said armature and passes through said openings in both of said end portions of said frame.

9. A permanent magnet latching solenoid as in claim 8 wherein said operator element is in press-fit engagement with said armature.

10. A permanent magnet latching solenoid as in claim 1 wherein said bobbin includes a connector socket with multiple contacting pins for mating with a connector of an external power supply.

11. A permanent magnet latching solenoid as in claim 10 wherein said socket includes multiple walls extending in parallel spaced relation to said pins.

12. A permanent magnet latching solenoid as in claim 11 wherein said socket includes a latching protrusion for retentive engagement with a mating connector.

13. A permanent magnet latching solenoid as in claim 1 wherein said frame includes side walls and said end walls for receiving said bobbin therebetween, said bobbin and said frame include cooperative interengageable portions for securing said bobbin assembly in a predetermined position in said frame.

14. A permanent magnet latching solenoid as in claim 13 wherein said cooperative interengageable portions include recesses in said walls and protrusions on said bobbin for engaging in said recesses.

15. A permanent magnet latching solenoid as in claim 14 wherein at least certain of said protrusions engage certain of said recesses in a snap interfitting relationship when said bobbin is inserted into said frame.

16. A permanent magnet latching solenoid as in claim 15 wherein a portion of said frame adjacent at least one of said recesses is deformable for staking against one of said protrusions engaged therein.

17. A permanent magnet latching solenoid as in claim 1 wherein said end walls of said frame have openings therethrough of lesser size than the cross-section of the respective end portion of said armature, and said operator element engages said armature and passes through said openings in both of said end walls of said frame.

18. A permanent magnet latching solenoid which comprises a bobbin that defines an axial passage, an electrical winding on said bobbin, magnetically permeable bushings engaged with said bobbin at each end of said passage, each of said bushings being of a right circular cylindrical outer configuration, said bushings defining with said passage a bore which extends axially of said bobbin from the distal end of one of said bushings to the distal end of the other of said bushings, an armature within said bore, said armature being of an axial length substantially less than the axial length of said bore and being freely reciprocable axially of said bore between two end positions in each of which one end portion of said armature is within the bushing at the respective end of said bore and an opposite end portion of said armature is at least near the bushing at the opposite end of said bore, an operator element attached to said armature, a separate magnetically permeable frame around said bobbin and including opposed end walls extending over said distal ends of said bushings, whereby each of said end walls overlies said distal end of the respective bushing and an assembly comprising said bobbin, said bushings and said armature fits within said frame between said end walls, said distal ends of said bushings being disposed adjacent to and in magnetically permeable coupling relationship with the respective end walls, at least one permanent magnet disposed within said frame between said bushings and magnetically coupling with said armature and said frame to magnetically latch said armature in each of said end positions, and said coil, when activated by an appropriate electrical pulse, creating a magnetic field coupling through said frame, armature and bushings to drive said armature from either of said end positions toward the other of said end positions.

19. A permanent magnet latching solenoid as in claim 18 wherein each of said bushings is in press-fit engagement in said bobbin.

20. A permanent magnet latching solenoid which comprises a bobbin that defines an axial passage, an electrical winding on said bobbin, magnetically permeable bushings engaged with said bobbin at each end of said passage, said bushings defining with said passage a bore which extends axially of said bobbin from the distal end of one of said bushings to the distal end of the other of said bushings, an armature within said bore, said armature being of an axial length substantially less than the axial length of said bore and being freely reciprocable axially of said bore between two end positions in each of which one end portion of said armature is within the bushing at the respective end of said bore and an opposite end portion of said armature is at least near the bushing at the opposite end of said bore, an operator element attached to said armature, a separate magnetically permeable frame around said bobbin and including opposed end walls extending over said distal ends of said bushings, whereby each of said end walls overlies said distal end of the respective bushing and an assembly comprising said bobbin, said bushings and said armature fits within said frame between said end walls, said distal ends of said bushings being disposed adjacent to and in magnetically permeable coupling relationship with the respective end walls, at least one permanent magnet disposed within said frame between said bushings and magnetically coupling with said armature and said frame to magnetically latch said armature in each of said end positions, wherein said bobbin defines a pocket on each side of said bore for receipt of a permanent magnet, a permanent magnet in each of said pockets, and said coil, when activated by an appropriate electrical pulse, creating a magnetic field coupling through said frame, armature and bushings to drive said armature from either of said end positions toward the other of said end positions.

21. A permanent magnet latching solenoid as in claim 20 wherein each of said magnets has a retentive press-fit in the respective pocket.

22. A permanent magnet latching solenoid as in claim 20 wherein each of said magnets is engaged in a press-fit relationship between said bobbin and said frame.

23. A method of forming a permanent magnet latching solenoid comprising the steps of:

providing a bobbin assembly that includes a magnetically non-conductive bobbin with a passage extending therethrough between opposite ends of said bobbin along a predetermined axis, an electrical coil on said bobbin, a magnetically permeable bushing at each end of said passage and defining, with said bobbin, a bore extending along said axis, and an armature disposed in and movable axially of said bore, each of said bushings having an inner end and an outer end;

providing a magnetically permeable frame having end walls that are spaced from one another a distance approximately equal to the distance between said outer ends of said bushings and having an open side extending between said end walls; and inserting said bobbin assembly into said frame through said open side with said opposite ends of said bushings adjacent said end walls.

24. A method of forming a permanent magnet latching solenoid as in claim 23 including the step of inserting at least one permanent magnet between said frame and said bobbin assembly.

25. A method of forming a permanent magnet latching solenoid as in claim 24 including the step of press-fitting at least two permanent magnets between said bobbin assembly and said frame, on opposite sides of said bobbin.

26. A method of forming a permanent magnet latching solenoid as in claim 23 including the steps of providing said frame with recesses and said bobbin assembly with protrusions for engaging said recesses when said bobbin assembly is inserted into said frame, and engaging said protrusions in said recesses during said insertion of said bobbin assembly into said frame.

27. A method of forming a permanent magnet latching solenoid as in claim 26 including the step of staking a portion of said frame against at least one of said protrusions, thereby securing said bobbin assembly and said frame in predetermined positions relative to one another.

28. A method of forming a permanent magnet latching solenoid as in claim 23 wherein the step of providing said bobbin assembly includes a step of retentively engaging one of said bushings to said bobbin at each end of said passage.

29. A method of forming a permanent magnet latching solenoid as in claim 28 wherein each of said bushings is press-fit into said bobbin.

30. A method of forming a permanent magnet latching solenoid as in claim 23 wherein at least one of said end walls is provided with an opening therethrough, and including the steps of inserting an operating element through said opening and affixing said operating element to said armature in said bobbin.

31. A method of forming a permanent magnet latching solenoid as in claim 30 wherein each of said end walls is provided with an opening therethrough and said armature has a central opening therethrough, and including the step of inserting such an operating element through both of said end walls and through said armature.

32. A permanent magnet latching solenoid which comprises a bobbin that defines an axial passage, an electrical winding on said bobbin, magnetically permeable bushings in press-fit engagement within said bobbin at each end of said passage, said bushings being of axial lengths substantially equal to one another and defining with said passage a bore which extends axially of said bobbin from the distal end of one of said bushings to the distal end of the other of said bushings, an armature within said bore, said armature being of an axial length substantially less than the axial length of said bore and being freely reciprocable axially of said bore between two end positions in each of which one end portion of said armature is within the bushing at the respective end of said bore and an opposite end portion of said armature is at least near the bushing at the opposite end of said bore, an operator element attached to said armature, a separate magnetically permeable frame around said bobbin and including end walls extending over the distal ends of said bushings, whereby each of said end walls overlies said distal end of the respective bushing and an assembly comprising said bobbin, said bushings and said arm armature fits within said frame between said end walls, said distal ends of said bushings being disposed adjacent to and in magnetically permeable coupling relationship with the respective end walls, permanent magnets disposed on opposite sides of said bobbin, within said frame, between said bushings, said magnets mounted by press-fit engagement with said bobbin and with said frame and magnetically coupling with said armature and said frame to magnetically latch said armature in each of said end positions, and said coil, when activated by an appropriate electrical pulse, creating a magnetic field coupling through said frame, armature and bushings to drive said armature from either of said end positions toward the other of said end positions.

* * * * *